US005815365A

United States Patent [19]

Stege

[11] Patent Number: 5,815,365

[45] Date of Patent: Sep. 29, 1998

[54] CONTROL CIRCUIT FOR A MAGNETIC SOLENOID IN A MODULATING VALVE APPLICATION

[75] Inventor: Daniel K. Stege, Wauwatosa, Wis.

[73] Assignee: Erie Manufacturing Company, Milwaukee, Wis.

[21] Appl. No.: 759,784

[22] Filed: Dec. 3, 1996

[51] Int. Cl.[6] ..... H01H 47/22

[52] U.S. Cl. ..... 361/195; 361/156; 361/194

[58] Field of Search ..... 361/195, 152–156, 361/194

[56] References Cited

U.S. PATENT DOCUMENTS

| | | | |
|---|---|---|---|
| 2,906,927 | 9/1959 | Schrack | 361/156 |
| 3,064,165 | 11/1962 | Kennedy | 361/156 |
| 3,634,735 | 1/1972 | Komatsu | 361/194 |
| 3,743,898 | 7/1973 | Sturman | 361/194 |
| 3,921,899 | 11/1975 | Hamilton . | |
| 4,257,081 | 3/1981 | Sauer et al. | 361/156 |
| 4,271,450 | 6/1981 | Nishimura et al. | 361/155 |
| 4,533,972 | 8/1985 | Ohashi | 361/156 |
| 4,549,448 | 10/1985 | Kittle . | |
| 4,570,509 | 2/1986 | Nighswonger . | |
| 4,675,776 | 6/1987 | Howell | 361/156 |
| 4,718,454 | 1/1988 | Appleby | 361/156 |
| 4,908,731 | 3/1990 | Richeson, Jr. | 361/156 |
| 5,117,233 | 5/1992 | Hamos et al. . | |
| 5,126,643 | 6/1992 | French . | |
| 5,278,455 | 1/1994 | Hamos . | |
| 5,347,421 | 9/1994 | Alexanian | 361/156 |

FOREIGN PATENT DOCUMENTS

| | | | |
|---|---|---|---|
| 2043012 | 3/1975 | Germany | 361/156 |
| 2805342 | 8/1979 | Germany | 361/156 |

*Primary Examiner*—Fritz Fleming
*Attorney, Agent, or Firm*—Andrus, Sceales, Starke & Sawall

[57] ABSTRACT

A solenoid control circuit is disclosed for providing the initial pull-in power to a magnetically-held solenoid and thereafter providing a release-pulse upon power loss to the circuit to release the solenoid. The solenoid control circuit has an AC input which is converted to a DC power supply. Power is supplied to an energy storage device after an initial time delay. After the time delay, the magnetic solenoid is tripped to its hold-in position. After being tripped, the magnetic solenoid is held in its hold-in position by the magnetic properties of the solenoid. Upon power interruption to the circuit, the solenoid is held in its tripped position for a desired period of time. After the time delay has expired, the energy storage device is discharged in an opposite direction through the magnetic solenoid, such that the magnetic solenoid is returned to its extended position. The circuit is employed in a biased modulating valve application to control operation of a solenoid which governs engagement and disengagement of a drop-out gear assembly in the valve drive system, to disengage the valve drive system when power is interrupted for a period of time exceeding the time delay.

10 Claims, 3 Drawing Sheets

CONTROL CIRCUIT FOR A MAGNETIC SOLENOID IN A MODULATING VALVE APPLICATION

BACKGROUND OF THE INVENTION

The invention relates to the use of a magnetically-held solenoid in a modulating valve, and more particularly to a method and apparatus to control the power to a magnetic solenoid in a modulating valve application.

Modulating valves control the amount of liquid flow through a system such as a cooling or heating application. A modulating valve typically has a valve plug which is operated by an electric motor to control the amount of flow through the modulating valve. The electric motor is connected to the valve plug through a series of gears. In some modulating valve applications, an electromagnetic solenoid controls a set of gears which are movable between an engaged and a disengaged position such that the electric motor can only move the valve plug when the gears are engaged. The electromagnetic solenoid allows the control circuit of the modulating valve to selectively engage or disengage the valve plug from the electric motor depending on the power supply level.

Typical electromagnetic solenoid actuators have an energizing coil and an armature which moves along the axis of the coil when an appropriate electromagnetic field is induced by providing a source of power to the windings of the coil. The electromagnetic solenoid is considered retracted when the armature has moved from one position when the coil is not energized, to a second position when the coil is sufficiently energized to cause such movement of the armature. Although it is understood that the armature may be biased to move in either direction, for ease of discussion in the foregoing description of the invention, the solenoid will be considered retracted when the armature is pulled into the solenoid body against the force of a biasing element, such as a spring, which normally urges the armature to its outward or extended position.

Electromagnetic solenoids require relatively high "pull-in" power to initiate activation. That is, a relatively high amount of electric power must be supplied to the solenoid to induce a magnetic field of sufficient strength to move the internal armature, or plunger, into the solenoid body. After the electromagnetic solenoid is retracted, less power is required to maintain the "holding" state; this power level is known as the holding power. In many prior electromagnetic solenoid control circuits, the control circuit continues to supply the high "pull-in" power even after the solenoid has been retracted. While the solenoid is in the holding state, the difference between the high pull-in power initially required and the holding power is dissipated by the solenoid, creating excess heat and wasting electrical power. The excessive heat created can shorten the life of a solenoid and/or require an oversized solenoid for a given application.

Attempts have been made to limit the power to solenoids by switching in a power resistor after solenoid activation. However, the excess power is then dissipated in the power resistor and, although the solenoid does not experience the excess heat, the power resistor does and the overall circuit still uses the same amount of power and must dissipate the excess heat.

Others have attempted to limit the holding power through the use of various switching means but have required the use of a special dual coil solenoid, or a-center-tapped solenoid, which adds to the cost of the solenoid and/or increases the overall size of the solenoid package. Examples of such attempts are U.S. Pat. Nos. 4,630,166, 4,032,823, and 3,689,808. Yet other attempts have used step-up transformers and mechanical switches which both add significantly to the overall size of the circuit and are therefore unacceptable in applications where space is limited. U.S. Pat. No. 3,943,416 is an example using a mechanical switch and U.S. Pat. No. 3,562,602 uses a step-up transformer.

Finally, attempts have been made to monitor and limit the power supplied to the electromagnetic solenoid after activation through the use of switching circuitry, such that after activation, the circuitry provides only the required holding power. For example, solenoid control circuits have been constructed which include sensing the supply voltage and providing relatively high pull-in power to the solenoid for a brief predetermined time after the power supply is connected and thereafter limiting the relatively high pull-in power to a reduced holding power to the solenoid. The holding power is created by a power limiting circuit, which provides only the reduced holding power to the solenoid as long as a voltage detector senses that the power supply is present. While this circuitry has the advantage of only applying the required holding power to the electromagnetic solenoid after activation, it still suffers from the requirement that power must be applied continuously to the solenoid to hold the solenoid in its activated position.

It is an object of the invention to provide a control circuit for operating a magnetically held solenoid in a modulating valve application. A further object of the invention is to provide a control circuit which reduces the amount of power required to operate the magnetically held solenoid in the modulating valve. It is another object of the invention to retract the solenoid during normal valve operation and extend the magnetic solenoid should power be disrupted to the valve, such that a return spring can move the valve to a desired position.

SUMMARY OF THE INVENTION

The present invention overcomes the aforementioned problems and provides a method and apparatus that initially provides a forward pull-in electrical pulse to a magnetically-held solenoid, and thereafter the magnetic properties of the solenoid maintain the solenoid in a retracted position.

The invention provides a magnetically-held solenoid which selectively engages and disengages the gear mechanism for operating the modulating valve to which the magnetically-held solenoid is connected. The apparatus of the invention further includes a control circuit for selectively retracting and extending the magnetic solenoid.

The control circuit consists of a full wave rectifier for converting an AC power supply to a constant DC voltage. The DC voltage from the full wave rectifier is coupled to the magnetically-held solenoid through a time delay circuit and a primary energy storage device. After power is supplied to the circuitry, the time delay circuit delays the retraction of the solenoid for a brief period of time. The primary energy storage device, such as a common capacitor, is positioned between the time delay circuit and a first terminal of the magnetic solenoid, such that the primary energy storage device will charge during normal periods of power being supplied to the magnetic solenoid.

Connected between the capacitor and a second terminal of the magnetic solenoid is a discharge path for the primary energy storage device. During normal operations, a switching device in the discharge path prevents the capacitor from discharging through the second terminal of the magnetic solenoid. Upon power being disrupted from the solenoid control circuit, a trigger circuit activates the switching device in the discharge path between the primary energy storage device and the magnetic solenoid. Included in the trigger circuit is a second energy storage device that discharges at a specific rate, thereby creating a time delay which prevents the magnetic solenoid from extending during brief periods of energy loss, such as fluctuations in the power supply. After the time delay has passed in the trigger circuit, the primary energy storage device discharges through the second terminal of the magnetic solenoid, causing the magnetic solenoid to move to an extended state at which time the plunger is pulled out of the solenoid body, in accordance with its normal operation.

The solenoid control circuit of the present invention is shown and applied to a bidirectional motor driven modulating valve which is biased in one direction, either toward its open or closed position, in the event electrical power is lost. The valve includes an electric motor which drives the valve, either toward its closed or open position, and a gear train connecting the electric motor and the valve. The gear train includes first and second gear train sections, and the magnetic solenoid actuator disengagably connects the first and second gear train sections. In the event of a power loss, power to the solenoid is cut off and the solenoid moves to its extended position to disengage the first and second gear strain sections, which allows the valve return spring to either completely open or completely close the valve, depending upon the configuration of the return spring. In normal operation of the valve after power is supplied to the solenoid to retract the solenoid and maintain engagement of the first and second gear train section, the control circuit of the invention functions to monitor the power supply level and store energy to extend the solenoid when power is lost.

Various other features, objects, and advantages of the invention will be made apparent from the following detailed description and the drawings.

BRIEF DESCRIPTION OF THE SEVERAL VIEWS OF THE DRAWINGS

The drawings illustrate the best mode presently contemplated for carrying out the invention. In the drawings.

DETAILED DESCRIPTION OF THE INVENTION

Figure 1:
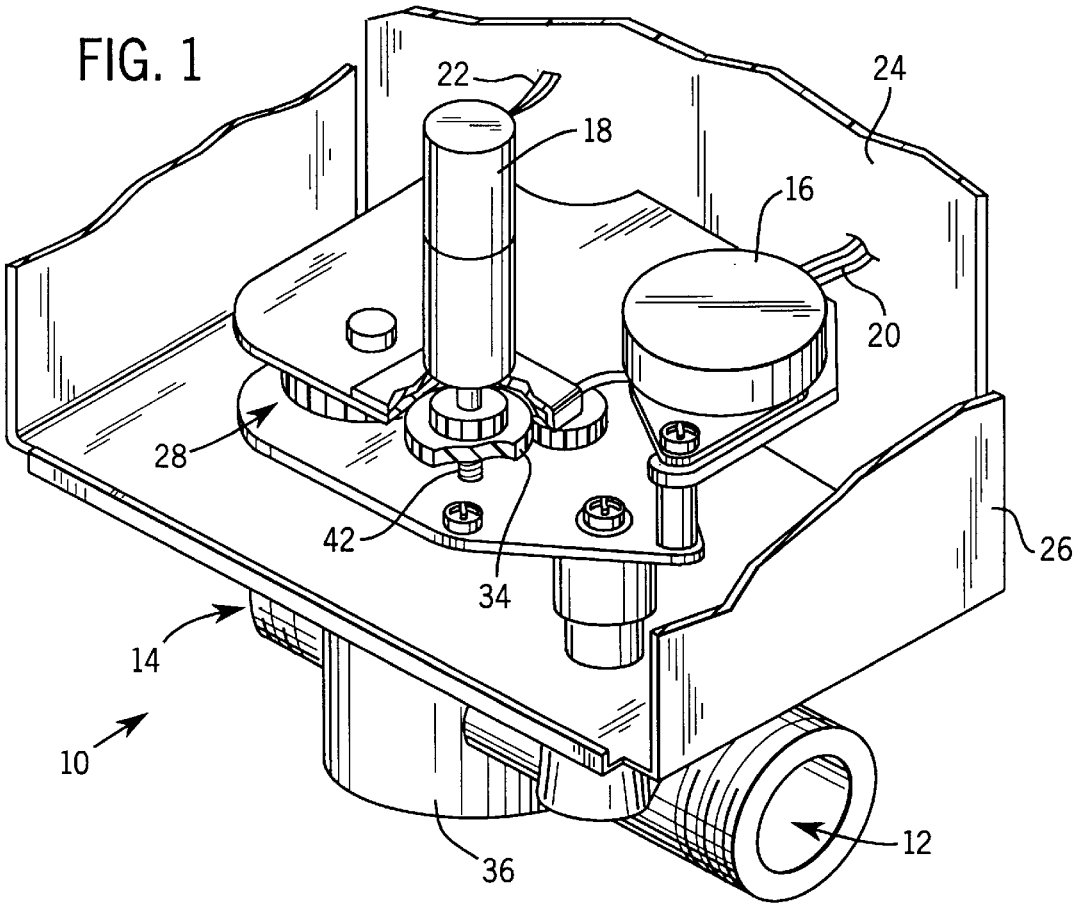
FIG. 1 is a perspective view of a modulating valve having a magnetically-held solenoid incorporating the solenoid control circuit of the present invention.

FIG. 1 shows a modulating valve 10 having an inlet passage 12 and a discharge passage 14. Modulating valve 10 has an internal plug member (not shown) for controlling fluid flow therethrough. An example of such a valve and plug member is disclosed in U.S. Pat. application Ser. No. 07/922,637 now issued as U.S. Pat. No. 5,397,098, incorporated herein by reference.

Fluid flow through the modulating valve 10 is controlled by a bidirectional motor 16 which moves the plug member of valve 10 between its various positions, in a manner as is known. Motor 16 is disengagable from the plug member of modulating valve 10 by a magnetically held solenoid 18, the operation of which will be described in greater detail below. Bidirectional motor 16 has motor leads 20 which are connected to an external valve control (not shown), such as a thermostat, for controlling fluid flow through the valve.

Magnetic solenoid 18 is a standard magnetically-held solenoid actuator, such as for example Model No. TDS-KO6B-22 sold by Takahashi Electric Company, and has circuit leads 22 connected to a solenoid control circuit which is later described with reference to FIG. 4. The magnetic solenoid 18 contains a permanent magnet which holds the solenoid in a retracted position, as is known. To move the magnetic solenoid 18 to an retracted position, a forward source of electricity must be applied to the solenoid 18. Once the electricity has been supplied to retract solenoid 18, the permanent magnet in solenoid 18 holds the solenoid 18 in an retracted state indefinitely without any further supply of electric power. To release the solenoid 18 from the retracted state, a reverse supply of electric power must be applied to the solenoid 18. A circuit board 24 contains the electronic components for controlling motor 16 and solenoid 18. Circuit board 24 is securely held within a valve controller housing 26 of valve 10 in a manner as is known.

Figure 2:
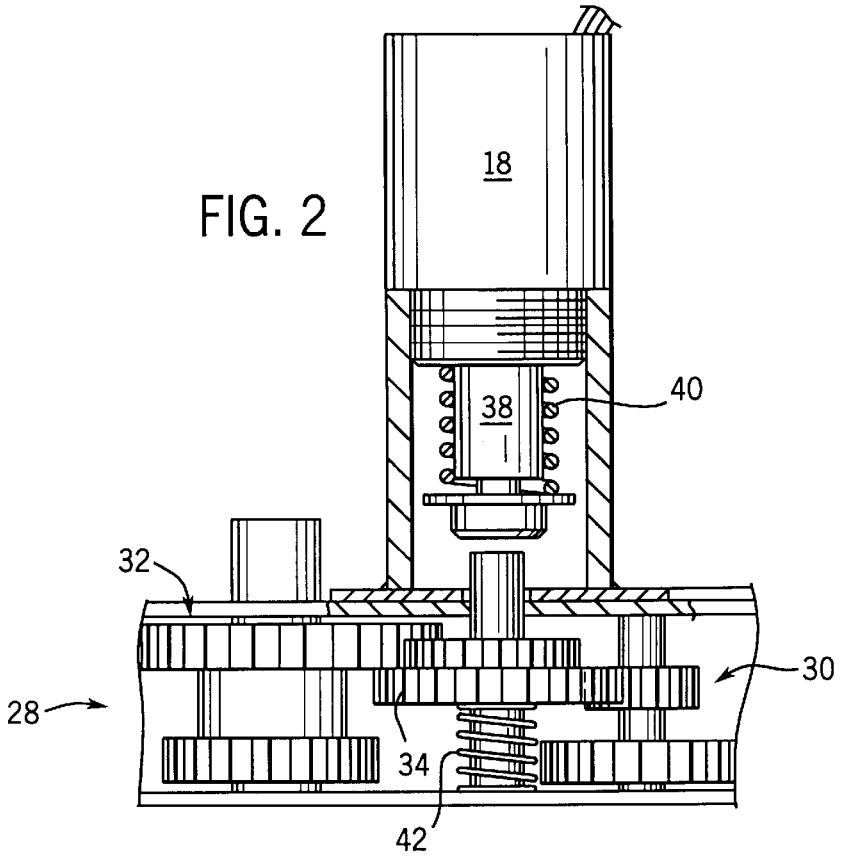
FIG. 2 is a partial sectional side view of a portion of the modulating valve of FIG. 1 in a solenoid retracted state.
Figure 3:
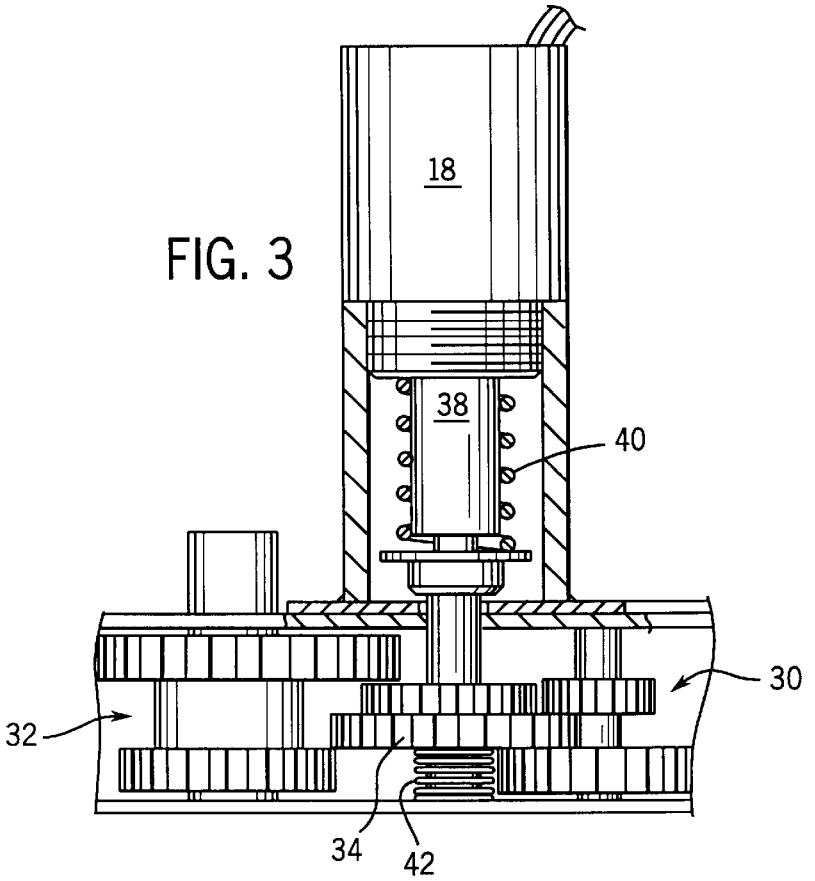
FIG. 3 is a partial sectional side view of a portion of the modulating valve of FIG. 1 in a solenoid extended state.

Bidirectional motor 16 drives a drive gear (not shown) in a valve open direction or in a valve closed direction. Through the drive gear, the bidirectional motor 16 drives a gear train 28, FIG. 2, which comprises a first gear train section 30 and a second gear train section 32. First and second gear train sections 30, 32 are disengagably connected by a dropout gear assembly 34 which is disengagable by operation of magnetic solenoid 18. FIG. 2 shows modulating valve 10 with magnetic solenoid 18 retracted and the first and second gear train sections 30, 32 engaged through the dropout gear assembly 34. FIG. 3 shows modulating valve 10 with magnetic solenoid 18 extended and dropout gear assembly 34 in a disengaged position, in which dropout gear assembly 34 disengages the first and second gear train sections 30, 32.

While dropout gear assembly 34 is in the engaged position as shown in FIG. 2, the bidirectional motor 16 drives the first gear train section 30 which in turn drives second gear train section 32 through the engaged dropout gear assembly 34. Second gear train section 32 engages an actuator shaft (not shown) which extends downwardly into the valve body 36 to move the valve plug member in the modulating valve 10 in the valve open direction or in the valve closed direction depending upon the system requirements.

FIGS. 2 and 3 show the two positions of magnetic solenoid actuator 18. FIG. 2 shows magnetic solenoid actuator 18 after having been electrically pulled in and being magnetically held with the dropout gear assembly 34 engaging the first gear train section 30 and the second gear train section 32. After an electrical power pulse is applied to the magnet solenoid actuator 18, the solenoid plunger 38 is in a pulled-in position which compresses a plunger spring 40. While the plunger 38 is magnetically held in the retracted position shown in FIG. 2, against the outward bias of plunger spring 40, the dropout gear assembly 34 is biased upward into an engaged position under the influence of a dropout gear assembly spring 42, permitting the bidirectional motor 16 to drive gear train 28. The gear train 28 in turn controls the position of the internal plug member in valve body 36, thereby variably regulating the volume of fluid flow through the inlet passage 12 (FIG. 1) and out the discharge passage 14.

When power is lost or cut off to valve 10, either during normal power downs or during abnormal power outages, it is desirable that valve 10 assume a predetermined position—either completely opened or completely closed. In accordance with conventional technology, valve 10 includes a return spring for biasing its plug member toward either the closed position or open position, depending upon the particular valve construction. In this manner, the plug member of valve 10 automatically assumes the position toward which it is biased when plunger 38 of solenoid 18 is extended to its FIG. 3 position to disengage drop-out gear assembly 34 from first and second gear from sections 30 and 32, respectively.

Initially, when electric power is disrupted to valve 10 and magnetic solenoid 18, the magnetic properties of solenoid 18 act to hold the plunger 38 in its retracted position. In the retracted position, the dropout gear assembly 34 engages both gear trains 30 and 32. Because of the frictional resistance of the gear train 28 and bidirectional motor 16, the internal plug member is held in the position it was in before power outage. To release the plunger 38 to enable the valve plug member to move to its open or closed position, a set amount of power must be pulsed to the magnetic solenoid 18 in a reverse direction, which in turn releases the plunger 38 and allows plunger spring 40 to extend plunger 38 and move dropout gear assembly 34 in a downward direction against the force of spring 42 to its extended position of FIG. 3, which disengages the first gear train section 30 and the second gear train section 32, thus disengaging bidirectional motor 16.

Once the magnetic solenoid 18 is powered up, plunger 38 is moved to its retracted position of FIG. 2 against the force of spring 40 and is magnetically held in its retracted position during normal operation of modulating valve 10. After plunger 38 is moved to its pull-in position, the magnetic solenoid 18 consumes no power during normal operating circumstances.

Figure 4:
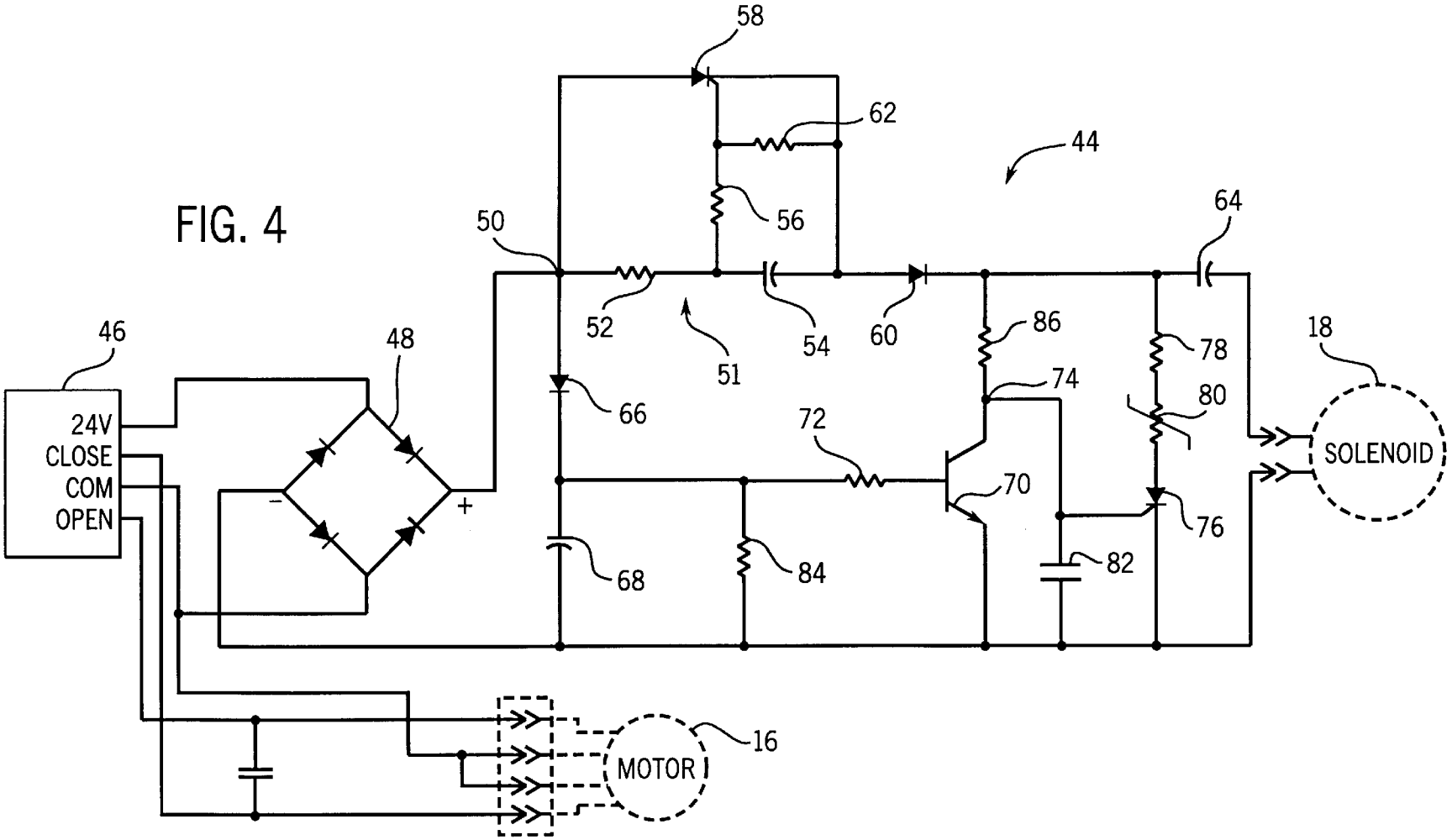
FIG. 4 is a detailed circuit diagram of the preferred embodiment of the solenoid control circuit incorporated into the modulating valve of FIG. 1.

FIG. 4 shows a solenoid control circuit 44 mounted to circuit board 24 to control generation of magnetic solenoid 18. As noted previously, the permanent magnet of solenoid 18 holds the plunger 38 in the retracted position, thereby requiring less power consumption and lower heat production than previous electromagnetically-held solenoid modulating valves. The solenoid control circuit 44 provides an initial pull-in power pulse to solenoid 18, and includes a source of stored power which is used to release the magnetic solenoid 18 upon power loss to the modulating valve 10, permitting the modulating valve 10 to return to a desired position after a power interruption longer than a preselected duration. The control circuit 44 includes a time-delay, permitting the magnetic solenoid 18 to remain retracted during a brief power interruption.

The solenoid control circuit 44 is connected to a power supply through a four-pin terminal block 46. Connected between 24 volts and common of the terminal block 46 is an AC to DC converter 48, such as, but not limited to, a full wave rectifier as shown in FIG. 4. In the preferred embodiment of the invention, the AC to DC converter 48 converts the 24 volt AC supply to a DC voltage which is present at node 50.

Connected to node 50 is a first time delay circuit 51 consisting of resistor 52 and capacitor 54. The values of resistor 52 and capacitor 54 can be varied depending upon amount of time delay required. In the preferred embodiment of the invention, resistor 52 is 10 kΩ, while the capacitor is 220 $\mu$F. The point of connection between the resistor 52 and capacitor 54 is connected through a resistor 56 to a switching device, such as the gate of an SCR 58. After the time delay created by resistor 52 and capacitor 54, the SCR 58 is turned on such that the SCR 58 allows full line power to flow through SCR 58 and a diode 60 to charge a primary energy storage device, such as a capacitor 64. Resistor 52 and capacitor 54 act as a time delay to prevent the capacitor 64 from beginning to charge until a small time delay after power is supplied to the system. A resistor 62 is connected between the gate and cathode of the SCR 58 to hold the gate of SCR 58 closed during no power periods, thus preventing false triggering of the SCR 58. After the SCR 58 triggers, the full line power flows through diode 60 and begins to charge the capacitor 64. The current flowing through capacitor 64 provides a forward electric pulse to the magnetic solenoid 18 which retracts the plunger 38 as shown in FIG. 2. During normal operation with power supplied to modulating valve 10, the plunger 38 is magnetically held in the position shown in FIG. 2.

As power is applied to the solenoid control circuit 44, current flows through a diode 66 to charge a second energy storage device, such as a capacitor 68. Since no resistor is positioned between the power supply (node 50) and common ground, the capacitor 68 charges almost instantaneously upon power being turned on. Capacitor 68 is also connected to the base of a transistor 70 through a series resistance 72. Because of the positive voltage stored by capacitor 68 and applied to the base of transistor 70, the transistor 70 is turned on upon power-up, thereby effectively connecting a node 74 to ground through the transistor 70. The gate of an SCR 76 is also pulled to ground, thereby turning off SCR 76. Therefore, when power is initially applied to the solenoid control circuit 44, capacitor 64 is charged through SCR 58 after an initial time delay, while SCR 76 is almost instantaneously turned off to prevent the flow of power from capacitor 64 through a resistor 78 and a fuse 80 connected between capacitor 64 and SCR 76. A capacitor 82 is connected between the gate of SCR 76 and ground in order to prevent line noise from inadvertently triggering the SCR 76.

When power is lost, or cut off to control circuit 44, such as during an outage or routine maintenance, capacitor 64 retains its charge because of the reverse bias of diode 60. In the preferred embodiment of the invention, the capacitor 64 will be charged to approximately 30 volts. Upon power loss, capacitor 68 can only discharge through a resistor 84 because of the reverse bias of diode 66. As the capacitor 68 discharges, the voltage at the base of transistor 70 decreases, until the transistor 70 eventually turns off after a time delay. After transistor 70 is turned off, the gate of SCR 76 is pulled high by resistor a 86 such that the SCR 76 will be turned on. As the SCR 76 is turned on, the capacitor 64 is able to quickly discharge through a power discharge bypass including resistor 78, fuse 80 and SCR 76. This discharge of capacitor 64 through the power discharge bypass and magnetic solenoid 18 acts to release the plunger 38 to its position shown in FIG. 3. After the plunger 38 has been released, the magnetic solenoid 18 will hold the plunger 38 in the position shown in FIG. 3 for as long as power is removed from the solenoid control circuit 44. Fuse 80 is inserted between resistor 78 and SCR 76 in case SCR 76 incorrectly triggers when power is still being applied to the control circuit 44 to prevent a short circuit through resistor 86.

As previously mentioned, capacitor 68 and resistor 84 are selected to provide the desired time delay between power being interrupted to the circuit 44 and the time at which capacitor 64 is allowed to discharge and therefore move the plunger 38 out of magnetic solenoid 18. In the preferred embodiment of the invention, capacitor 68 is a 10 $\mu$F capacitor and resistor 84 is 200 kΩ to provide approximately a 5 second time delay before the voltage at the base of transistor 70 falls below approximately 0.7 volts which turns off transistor 70. By selecting a time delay of approximately 5 seconds, the discharge of capacitor 64 is delayed to prevent the solenoid from being tripped during short power interruption to the solenoid control circuit 44.

Likewise, the time delay created by resistor 52 and capacitor 54 is typically less than 5 seconds and is included in the circuit for a situation when power is being supplied to the solenoid control circuit 44 at the instant the solenoid 18 is releasing. Since the capacitor 68 charges almost instantaneously upon power being supplied to the system, the SCR 76 is turned off almost instantaneously after power is supplied, which prevents the capacitor 64 from discharging immediately after power is supplied. After the small time delay created by resistor 52 and capacitor 54, power is supplied to capacitor 64 through the SCR 58 and diode 60.

Through the use of the magnetically-held solenoid 18, the typical average power consumption in the holding state is under 25 mW. In contrast, the typical average power consumption in the holding state for the prior art electromagnetic solenoid is approximately 5 W, a difference of magnitude of 200, which results in a considerable energy savings.

It is understood that the part numbers described are for illustrative purposes only and may be replaced with other comparable parts.

It is also recognized that other equivalents, alternatives, or modifications, aside from those expressly stated, are possible and within the scope of the appended claims.

I claim:

1. A solenoid control circuit for selectively retracting and extending a magnetically held solenoid, the control circuit comprising:

a power supply circuit connected to a power source and coupled to the magnetically held solenoid for supplying direct current power to operate the magnetically held solenoid;

a power storage device connected to both the power supply circuit and the magnetically held solenoid, the power storage device being charged when the solenoid control circuit is connected to the power source; and a power discharge bypass connected between the power storage device and the magnetically held solenoid to permit the discharge of the power storage device through the magnetically held solenoid to extend the magnetically held solenoid upon removal of the power source, wherein the power discharge bypass includes a switching device operable between an open and a closed position and a time delay circuit connected to the switching device to close the switching device to allow the power storage device to discharge through the magnetically held solenoid after a time delay following the removal of the power source.

2. The solenoid control circuit of claim 1 wherein the power supply circuit includes a time delay circuit and a switching device positioned between the power source and the power storage device, the time delay circuit being connected to the switching device to selectively close the switching device after a selected period of time after application of the power source to the solenoid control circuit.

3. The solenoid control circuit of claim 2 wherein the switching device is an SCR.

4. The solenoid control circuit of claim 1 wherein the second switching device is an SCR and transistor combination.

5. The solenoid control circuit of claim 1 wherein the power supply circuit is connected to an AC power source comprising an AC to DC converter connected between the AC power source and the power supply circuit.

6. The solenoid control circuit of claim 1 wherein the power storage device is a capacitor.

7. A method of selectively retracting and extending a magnetically held solenoid, the method comprising the steps of:

connecting a power source to a power supply circuit, the power supply circuit generating direct current power;

applying power from the power supply circuit to a power storage device after a first time delay following the connection of the power source;

retracting the magnetically held solenoid upon application of power to the power storage device;

storing a supply of energy in the power storage device;

closing a switching device in a power discharge bypass connected between the power storage device and the magnetic solenoid after a second time delay following the removal of the power source;

discharging the power storage device through the power discharge bypass and the magnetically held solenoid following the second time delay after the removal of the power source; and extending the magnetically held solenoid upon discharge of the power supply device.

8. A modulating valve for controlling the flow of a liquid, comprising:

an electric motor driving the modulating valve in a valve open and a valve closed direction;

a gear train connecting the electric motor and the modulating valve and comprising first and second gear train sections;

a magnetically held solenoid disengagably connecting the first and second gear train sections; and a solenoid control circuit comprising a power supply circuit connected to a power source, a power storage device connected between the power source and the magnetic solenoid, and a power discharge bypass connected between the power storage device and the magnetic solenoid to permit the discharge of the power storage device through the magnetic solenoid.

9. The modulating valve of claim 8 wherein the power supply circuit includes a first time delay circuit and a first switching device such that the first time delay circuit closes the first switching device after a desired delay following application of the power source to the solenoid control circuit.

10. The modulating valve of claim 9 wherein the power discharge bypass includes a second time delay circuit and a second switching device such that the second time delay circuit closes the second switching device allowing the power storage device to discharge through the magnetic solenoid following the removal of the power source.

* * * * *